US005244098A

United States Patent [19]

Hadden

[11] Patent Number: 5,244,098

[45] Date of Patent: Sep. 14, 1993

[54] MATERIAL SEPARATING APPARATUS AND METHOD

[75] Inventor: Robert J. Hadden, Middleboro, Mass.

[73] Assignee: The Read Corporation, Middleboro, Mass.

[21] Appl. No.: 970,294

[22] Filed: Nov. 2, 1992

[51] Int. Cl.[5] ..... B07B 1/28

[52] U.S. Cl. ..... 209/243; 209/420; 209/910

[58] Field of Search ..... 209/420, 421, 243, 244, 209/910; 198/550.2

[56] References Cited

U.S. PATENT DOCUMENTS

| | | | |
|---|---|---|---|
| D. 263,836 | 4/1982 | Read . | |
| 915,028 | 3/1909 | Devermann | 209/244 X |
| 2,163,766 | 6/1939 | Spencer | 209/244 |
| 3,241,671 | 3/1966 | Brauchla | 209/243 |
| 4,197,194 | 4/1980 | Read . | |
| 4,237,000 | 12/1980 | Read . | |
| 4,256,572 | 3/1981 | Read . | |
| 4,698,150 | 10/1987 | Wigoda | 209/421 |
| 5,082,555 | 1/1992 | Read | 209/244 |

FOREIGN PATENT DOCUMENTS

| | | | |
|---|---|---|---|
| 1230703 | 5/1986 | U.S.S.R. | 209/244 |

*Primary Examiner*—D. Glenn Dayoan
*Attorney, Agent, or Firm*—Richard P. Crowley

[57] ABSTRACT

An improved separating apparatus for separating a feed material into coarse material and a finer material. The separating apparatus includes a frame with a tall and short end, vibratory separating screen or rods as a separating surface within the frame, and a fixed, angled, feed directing plate as a funneling surface to direct feed material into the separating surface at the tall end of the frame. The separating apparatus includes a feed directing plate extension to extend the funneling surface of the apparatus and includes a support arm and a support bracket on the frame to move the feed directing plate extension between an angular extended use position and a non-use position adjacent the frame surface to permit the separating apparatus to be road-transportable.

14 Claims, 4 Drawing Sheets

MATERIAL SEPARATING APPARATUS AND METHOD

BACKGROUND OF THE INVENTION

Separating apparatus for separating coarse material from fine material are known, in which a screening apparatus includes a frame and a pair of sloping vibratory shaker screens supported within the frame. Generally, the frame has a tall end and a short end joined by two sides, and has an angular funneling surface at the tall end directed downwardly toward the upper shaker screen. Soil or other solid particulate material to be screened into coarse material and finer material is dumped onto the upper shaker screen, for example, from the shovel of a front-end loader, and coarse material falls from the lower end of the upper shaker screen outside of the frame, while the material which is finer than the screen of the upper frame passes through the upper shaker screen to a lower vibratory screen of smaller opening dimensions which permits coarser material to be discharged at the one short end of the frame and finer material to pass through the lower shaker screen either onto a conveyor belt or be deposited within the frame for later retrieval.

Such separating apparatus may be portable and include at one end a towing means for a vehicle, and at the other end a set of wheels to provide transport of the apparatus to an operation site, and with the wheels moved relative to the frame between a road transport position and an operating position, generally with the frame on the ground. Such road-transportable vibratory loam and soil material screening apparatus are described in U.S. Pat. No. 4,197,194, issued Apr. 8, 1980; U.S. Pat. No. 4,237,000, issued Dec. 2, 1980; U.S. Pat. No. 4,256,572, issued Mar. 17, 1981; and Des. 263,836, issued Apr. 13, 1982, all hereby incorporated by reference, and which apparatus are known in the industry as Read SCREEN-ALL® soil separating apparatus (Read SCREEN-ALL® is the registered trademark of James L. Read, Middleboro, Mass.).

Generally, the pair of shaker screen assemblies in the above-described loam and soil material separating apparatus is secured on compression springs and the shaker assembly bounces on the springs in a rotary-type movement. Movement is imparted by the operation of an off-balance shaft mechanism secured to the upper and lower shaker mechanisms, generally by an off-balance flywheel secured to each end of a shaft, which shaft is driven by a hydraulic motor. Generally, the upper shaker screen is composed of a woven wire assembly of typically large diameter wire in order to withstand the impact of soil or another material dumped by a payloader directly onto the upper screen assembly, and which soil material may include large rocks or other heavy debris, while the screen of the lower shaker assembly is usually of a smaller diameter woven wire and having smaller openings selected for the particular separation desired.

While loam and soil material are generally quickly and efficiently separated in the above-described separating apparatus, where the feed material to the apparatus comprises a wide variety of material such as that found in landfills, which would include leaves, paper bags, sticks, as well as sand, soil, rocks, twigs, cans, bottles, domestic and industrial garbage and trash, and construction site debris, the separation of such material becomes more difficult.

There are a wide variety of vibratory screening apparatus employed to screen various, disparate feed-type materials, and which vibratory screening apparatus, rather than using woven wire screens, comprise comb or finger-like members composed of rods arranged in a series of decks over which the feed material is passed to be separated. The rod elements are downwardly sloping, overlapping, and spaced apart a defined distance to provide material separation. Typically, the screening decks are arranged in a shingle-array fashion or spaced apart, double shingle-array fashion, with each deck generally horizontally, or slightly downwardly tilted from the horizontal, and having a plurality or array of finger or rod-like members projecting from a transverse frame, so as to provide for the desired separation.

It is desirable to provide an improved separating apparatus and method, which apparatus remains road-transportable by vehicular transportation and which may be efficiently used by a variety of payloader vehicles, such as both front-end loaders and excavator-type payloaders to feed material to be separated onto the vibrating rod or screen separating surface.

SUMMARY OF THE INVENTION

The invention relates to an improved separating apparatus and method for the separating of material into coarse material and finer material. In particular, the invention concerns an improved separating apparatus which is road-transportable and which may be employed with a variety of material feeding devices, such as both front-end loaders and excavator-type payloaders.

The invention is directed to an improved separating apparatus, which may be portable, for separating coarse material from finer material, and which apparatus comprises a frame having a tall end and a short end joined by sides, with the tall end having a funneling surface defined by a feed or directing plate, extending inwardly and downwardly angled from the upper edge of the tall end, typically and optionally the sides may also include downwardly angled surfaces. The apparatus includes a vibratory material separating means sloping downwardly from the bottom end of the funneling surface to near the upper edge of the short end, and generally comprises a woven screen, a pair of spaced-apart woven screens, or a shingle arrangement of overlapping rod elements either as a single layer or spaced-apart layer, or more particularly in the case of a Read SCREEN-ALL® apparatus, a pair of spaced-apart, downwardly angled woven metal wire screens. The apparatus includes means to vibrate the material separating means, such as a concentric shaft, to provide for up and down vertical vibration of the spaced-apart rod elements or for forward vibration movement of the pair of woven screens.

Where the separating apparatus is portable, the apparatus also typically includes a vehicular wheel means, such as a set of wheels, at one end, movable relative to the frame between an operative position at a site with the frame on the ground or stabilized for use, and a transport position to transport the apparatus to an operation site, and hitch means to permit the vehicle to be towed to an operation site, typically at the other end of the apparatus.

The separating apparatus includes an improvement which comprises a directing plate extension means to extend upwardly the funneling surface from the tall end of the machine; a means at the tall end of the frame to connect the directing plate extension means adjacent to the said directing plate of the separating apparatus, and means to move the connected directing plate extension means between an upwardly angular extension support use position to extend upwardly the funneling surface of said directing plate extension means and a retracted, non-support, non-use position adjacent the surface of the frame. The improvement permits the use of the directing plate extension means by an excavator-type payloader and permits the vehicular transportation of the portable screening apparatus.

Generally, the directing plate extension means provides for extension upwardly and outwardly from the directing plate at about the same angle as the said directing plate, for example, about 45 degrees. However, if desired, the directing plate extension means may be at a slightly greater or lesser angle, ranging from 30 to 60 degrees, than the angle of said directing plate. Typically, the directing plate extension means comprises a flat, metal plate having an upper or lower edge, wherein the lower edge is hingedly connected to the upper edge of the tall end of the frame to permit hinged movement of the level directing plate extension means between the extended use and retracted, non-use positions. The means to move the directing plate means may comprise a support bracket means, such as a plurality of brackets, secured to the frame and an elongated support arm means, such as a plurality of support arms, each having a one and the other end, and mounted on the support bracket, with the one upper end of the support arms pivotably connected to the lower end of the plate extension directing means, with the support arm adapted to move between a travel non-use position, generally adjacent the side of the frame surface, and a directing plate extension support means extending angularly outwardly from the support bracket, with the lower other end of the support arm means secured in the upper bracket means to provide support for the directing plate extension means. The lower end of the support arm may be secured by a hitch pin in the support bracket and the support arm prevented from moving in a non-use position by positioning between the hitch pin and the frame surface. The improved separating apparatus of the invention thus provides for the employment of the separating apparatus with a loader, such as a front-end loader, and also permits the employment of the separating apparatus with an excavator-type payloader and permits the portability of the separating apparatus over the road when the extension plate directing means is in a retracted non-use position.

The prior art apparatus of the cited patents is designed for use generally with a payloader having a front-end mounted bucket which shovels or scoops material requiring separation into the bucket. The front-end loader raises the material over the tall end of the frame, then tilts the bucket towards the vibratory separating surface, pouring the material onto a downwardly-angled feed directing plate that directs the material onto the vibratory separating surface which slopes from the tall end of the apparatus towards the short end. The design of the apparatus is such that the size of the downwardly-angled feed directing plate is controlled by the height that the front-end loader bucket can reach, as well as over the road travel height limits.

It is desirable to allow the feed material to impact on the directing plate to start decompaction, particularly for landfill material, and to encounter a maximum amount of the vibratory separating surface to increase the opportunity for removing finer material from coarser material. In order to accomplish efficient separation, the unseparated feed material must be deposited high on the downwardly-angled feed directing plate and not partially or directly onto the separating surface to allow a flow from the feed plate onto the beginning of the separating surface. This result is best achieved when the bucket itself acts as an extension of the feed plate and the feed material is metered from the bottom edge of the bucket onto the top edge of the feed directing plate. It is essential that unseparated mixed feed material not be allowed to mix with separated material. This would occur if the full loaded bucket began to empty its contents without being in proper position relative to the feed directing plate. Material on the separating surface travels at a speed and direction determined by the vibrational force produced from the rotational movement of the eccentric shaft, while the material on the feed plate is directed to the separating surface by gravity through its steep angle. The separating process begins as the unseparated feed material moves from the fixed downwardly-angled feed directing plate onto the material separating surface. The bottom of the mixture is processed by the finer material falling through the separating surface, diminishing the size of the material as it progresses towards the short end of the apparatus, until the coarse material remaining on top of the separating surface falls off the short end of the apparatus, and is isolated by the frame from the finer material which has passed through, and is deposited within the frame for removal by a machine, such as a front-end loader, or by a conveyor.

The present separation apparatus design does not perform as efficiently when used in conjunction with an excavator-type of loader as it does when used with a front-end loader. The reason is that the directing plate is not of sufficient size (height) to allow the material to be dropped onto it with an excavator-type loader without having either unseparated feed material or having unscreened feed material land too far down the vibratory separating surface to allow for maximum opportunity to remove the finer material. Also, there can be, in some situations, an advantage to be gained in using an excavator instead of a front-end loader. This can be due to several factors, such as either material handling requirements, site conditions or availability of equipment. The use of an excavator with the current prior art design can mean a loss of productivity and therefore an increase in costs. The enlarging of the feed directing plate improves the productivity; however, it represents other problems. The overall height of the apparatus would then prevent a front-end loader from being able to reach the top of the directing plate to load unseparated feed material onto the vibratory separating surface. Also, excessive height would prevent the apparatus from being transportable over the road due to travel height limits as well as exceeding overall width restrictions.

The improvement relates to a movable directing plate extension capable of operating in two basic modes. First, to allow operation of the separating apparatus in a conventional fashion without hindering its ability to perform, while being fed by a front-end type or other loader, or to hinder road transport of the apparatus. Also, no obstruction can be introduced that would detract from the important feature of being able to remove the separated finer material from beneath the vibratory separating surface. Secondly, to provide means to move into place a directing plate extension to the existing fixed feed directing plate that would allow the apparatus to perform in an efficient fashion while being fed by an excavator-type loader. This directing plate extension allows for the feed material to be loaded onto the separating apparatus by an excavator, while preventing spillage over the directing plate which would cause contamination of separated material with unseparated feed material. Also, it allows for the excavator bucket to empty its contents against the directing plate extension without having to load directly onto the vibratory separating surface, which increases the efficiency and productivity of the separating apparatus when being fed by an excavator. The improved apparatus provides for a means of pivoting the directing plate extension into position to accommodate either a front-end loader or an excavator, and allows for optimal performance without loss of efficiency due to the method of feeding unscreened material, which is not possible without the improvement.

The apparatus has means for lifting or raising the directing plate extension into place from the conventional front-end loader feed mode into the excavator feed mode, either manually, by the movement of a support arm in a support bracket, or if desired, hydraulically, by the use of a hydraulic cylinder and movable positioned arm with the cylinder operated from existing hydraulic means of the separating apparatus. The design is such that it is possible to retrofit existing prior art apparatus with minimal modification to the frame through the attachment of hinge brackets, support arms, and support brackets. The apparatus has means for lifting the directing plate for easy installation or removal. Means are also included for the locking or retaining of the directing plate extension in either of the two modes of operation without causing interference while in the selected mode of operation.

Generally, a front-end loader comprises a vehicle having an extended boom with a hydraulic cylinder operated bucket at the end of the boom, with the bucket moving between a load carrying position, where the open section of the bucket extends upwardly, and a load depositing position, wherein the bucket is moved pivotably counterclockwise forward by the cylinder piston rod to an inclined load dumping position. An excavator comprises one or more extending boom arms, typically with a greater reach than a front-end loader, from a fixed position with a hydraulically operated bucket or shovel connected at the end of the one boom arm. The excavator bucket moves between a load carrying position, with the bucket open-faced facing upwardly, but beneath the boom arms, and a load depositing position, where the bucket rotates counterclockwise to position the open section of the bucket downwardly and generally horizontally to discharge the load. This method of operation and discharge of the excavator load causes difficulties in the depositing of the load onto the feed directing plate of the prior art apparatus. These differences in operation and depositing of load material of the front-end loader and excavator vehicles cause difficulties as set forth in the efficiency and operation of the prior art apparatus.

DESCRIPTION OF THE EMBODIMENTS

Figure 1:
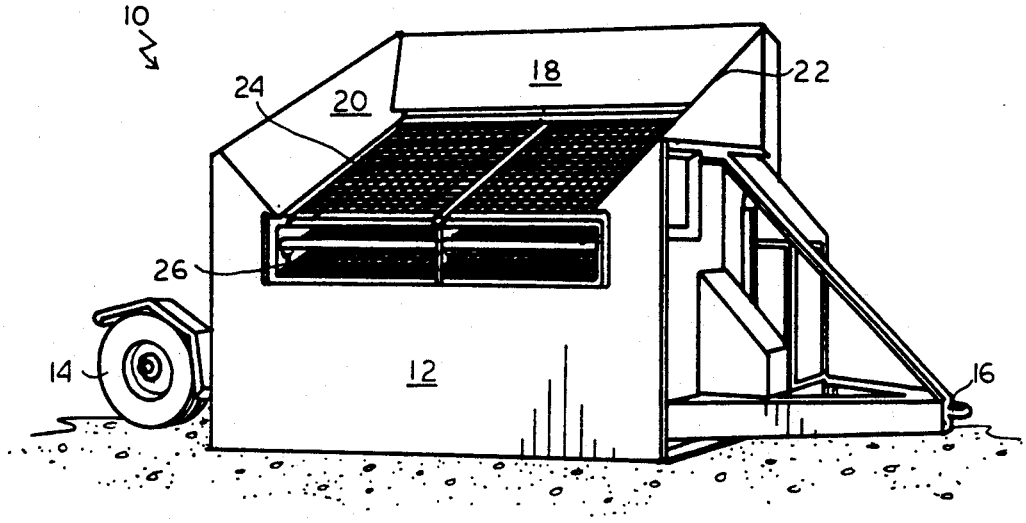
PRIOR ART FIG.1
FIG. 1 is a perspective view of a prior art separating apparatus in a use position.

FIG. 1 is a perspective view of a prior art SCREEN-ALL® apparatus 10 having a frame 12, a set of movable wheels 14 and a towing bar 16, with the frame having an inwardly-angled feed directing plate 18 to define a funneling surface, and angled side plates 20 and 22 to direct feed material onto an upper vibratory woven screen 24 spaced apart from a lower vibratory screen 26, the frame 12 shown resting on the ground 28 with the wheel 14 in a raised position.

Figure 2:
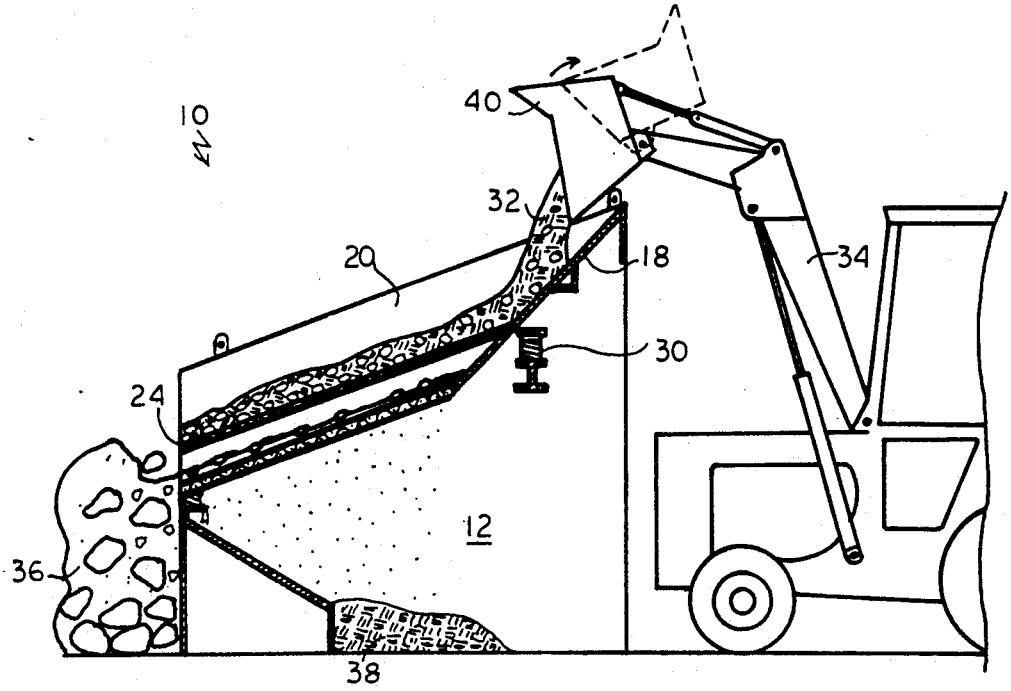
PRIOR ART FIG.2
FIG. 2 is a side sectional view of a prior art separating apparatus with a front-end loader depositing feed material into the apparatus.

FIG. 2 is a sectional plan view of the prior art apparatus 10 showing the upper screen on springs 30 and a mixture of solid, particulate, coarse and finer material, such as loam and soil material, 32 being fed onto the directing plate 18 and upper section of upper screen 24 from the bucket 40 of a front-end loader 34 to separate the material 32 into coarse material 36 and finer material 38 during the operation of the apparatus 10. The bucket 40 of the front end loader 34 is shown in dotted lines in the feed material carrying position.

Figure 3:
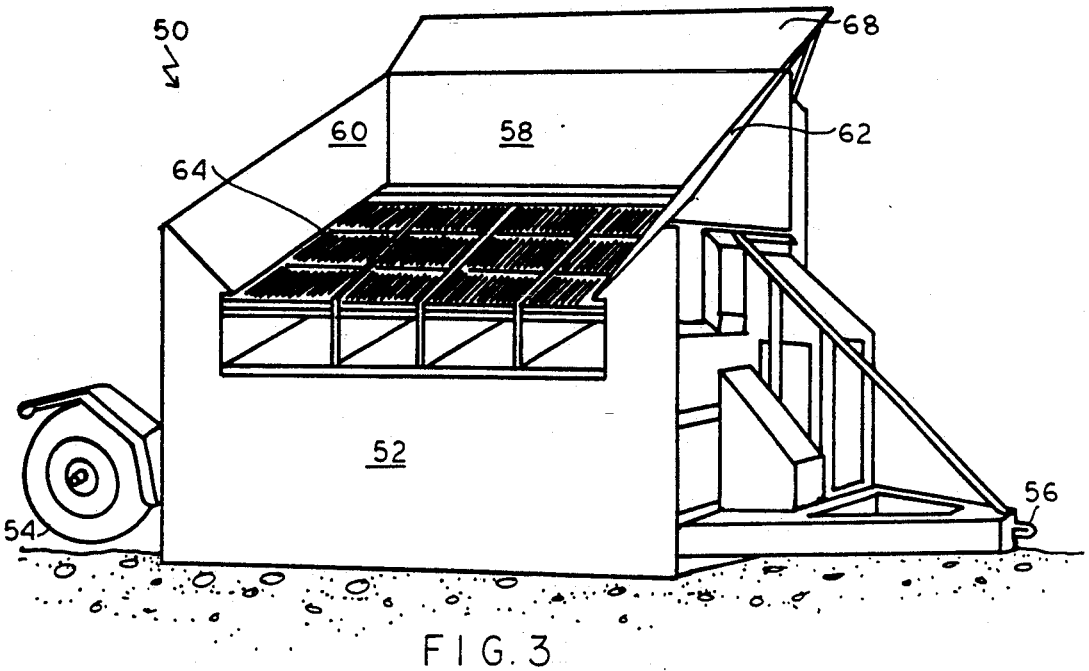
FIG. 3 is a perspective view of a separating apparatus of the invention with directing plate extension means in an extended, use position.

FIG. 3 is a perspective view of a separation apparatus 50 of the invention having a frame 52, a set of wheels 54 shown in the raised position, and a towing bar 56 to tow the apparatus to an operating site when the wheels are placed in the travel position. The apparatus 50 includes a fixed feed directing plate 58 at an angle of about 45 degrees with fixed similar angled sides 60 and 62. The apparatus 50 includes three layers of downwardly sloping, overlapping, vibratory spaced-apart rod elements 64 to separate a solid particulate feed material 66 deposited on the vibrating rod separating surface. The apparatus 50 includes a hinged supported feed directing plate extension 68 which extends outwardly and upwardly at the same angle as the fixed directing plate 58 to extend the funneling surface area and to raise the height of the upper edge of the funneling surface.

Figure 4:
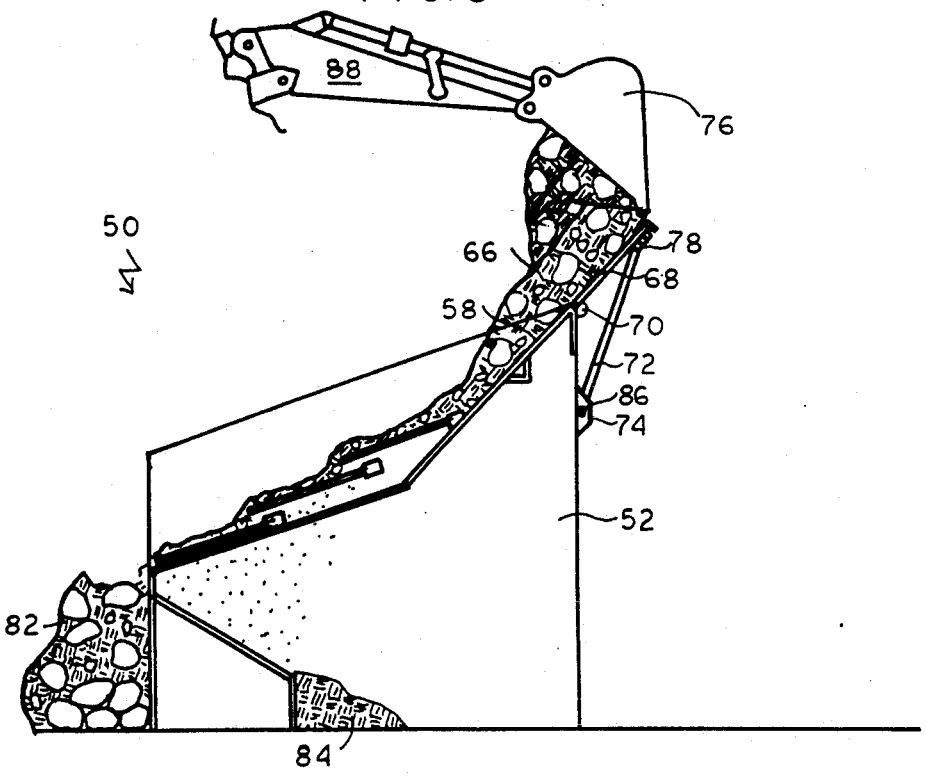
FIG. 4 is a side sectional view of the apparatus of FIG. 3 with an excavator depositing material onto the apparatus.

FIG. 4 is a side sectional view of the apparatus 50 of FIG. 3 which shows the feed directing plate extension 68 in an extended support position, the plate 68 is hingedly connected by hitch pins 70 to the upper edge of the fixed directing plate 58. As illustrated, the directing plate extension 68 is at the same 45 degree angle, but may be slightly lower or higher, e.g., 30 to 60 degrees, or vertically adjusted as angularly as desired. Typically, the directing plate extension 68 may have rib supports and is of the same general length as the fixed plate 58 and of the same height, for example, 2 to 4 feet, and usually composed of a flat metal plate material. The apparatus 50 includes a support arm 72 pivotably connected at the one upper end 78 to the upper section just below the upper edge of the plate extension 68, with the one end supported at a support angle of 30 to 45 degrees and a support bracket 74 secured to the frame 52. The apparatus 50 is illustrated in use with an excavator 88 having an extension boom and a scoop shovel 76 to deposit feed material 66 to be separated onto the plate extension 68, so that the feed material is fed onto the top upper portion of the vibrating rod elements of the rod separating surface for separation into a coarse material 82 and a finer material 84.

Figure 5:
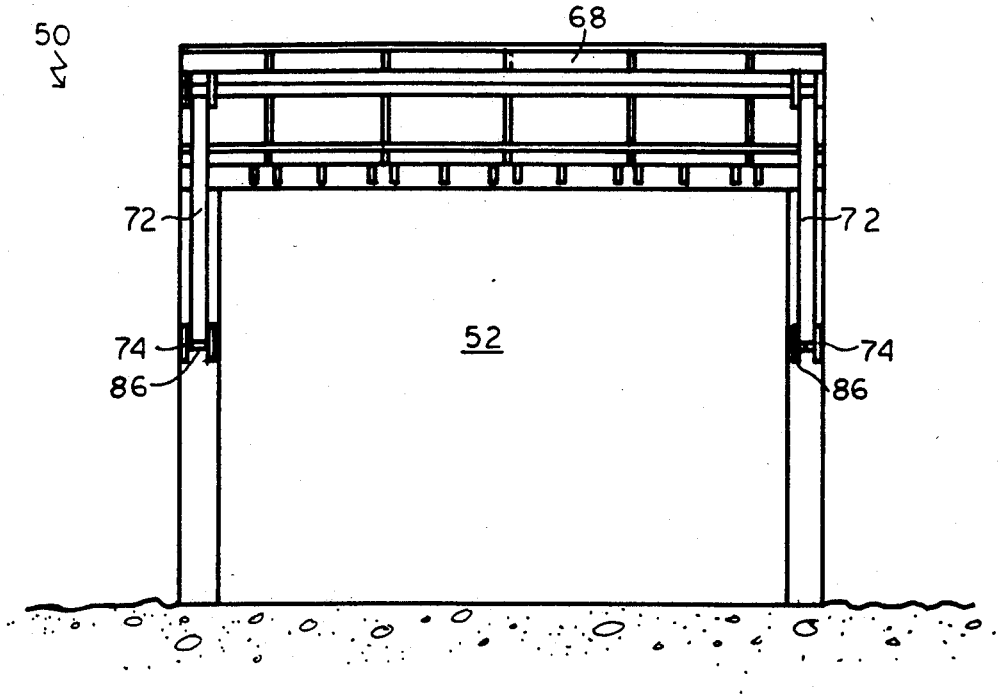
FIG. 5 is a back plan view of the apparatus of FIG. 4.

FIG. 5 is a back plan view of the apparatus 50 of FIG. 4 with the support arm 72 at one end secured by hitch pin 86 in the support bracket 74. The angle of the plate extension 68 can be raised by varying the length of support arm 72 such as by the use of different length arms, or an adjustable telescopic support arm, or support arm 72 may be comprised of a hydraulic cylinder with a piston to move the plate 68 into a desired angular support position.

Figure 6:
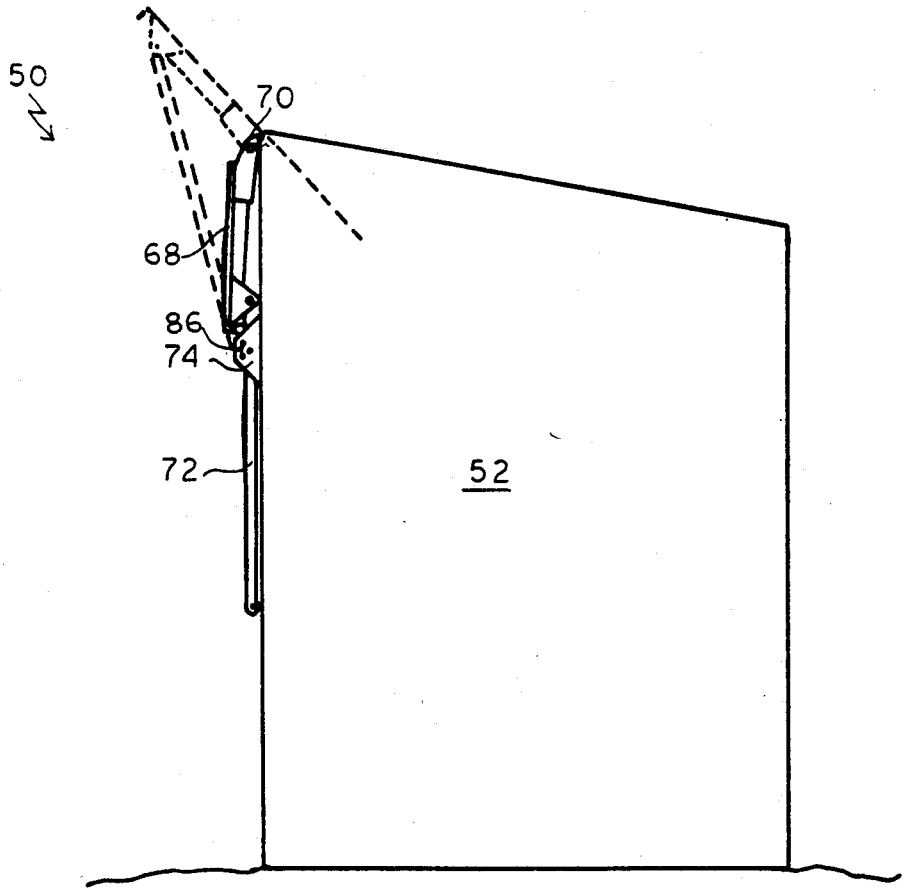
FIG. 6 is a side plan view of the apparatus of FIG. 3 with the directing plate extension means in a retracted, travel non-use position.

FIG. 6 is a sectional side view of the apparatus 50 with the support arm 70 in a retracted, level, non-use position adjacent the frame 52 surface, and the support arm 72 positioned within support bracket 74 and with plate 68 hingedly moved adjacent the frame 52 surface and aligned generally with the support arm 72, with dotted lines illustrating the raising of the plate 68 to the support position of FIG. 4 and 5. The end of support arm 72 fits within the support bracket 74 and can be secured against the frame surface 52 with hitch pin 86. In the level position, as illustrated in FIG. 6, the apparatus 50 with the set of wheels placed on the ground and the frame 52 lifted may be towed by a tow bar by another vehicle to an operation site for use without violation of vehicular rules or height restrictions, which might occur if the plate 68 were to remain in the extended plate use position.

Figure 7:
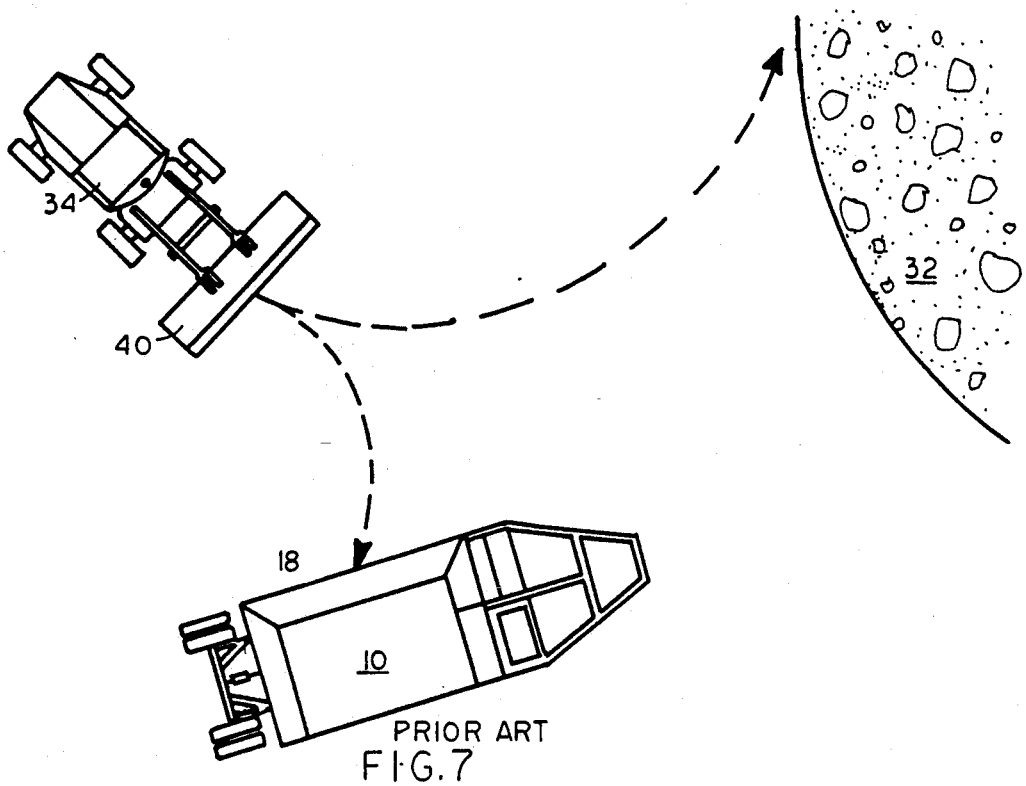
PRIOR ART FIG. 7
FIG. 7 is a top plan illustrative schematic view of the prior art operation of a prior art separating apparatus with a front-end loader.

FIG. 7 shows a view of the operation of a prior art SCREEN-ALL® separating apparatus 10 with a front-end loader 34 with its bucket 40 (see FIGS. 1 and 2). In operation, the screening apparatus 10 has been moved to a site for operating with the frame 12 on the ground. The front-end loader then travels back and forth between the stock pile of feed material 32 to be separated and the apparatus 10 and the feed material is deposited onto the angled level feed directing plate 18 and the vibratory separating surface 24, with the front-end loader approaching the apparatus on the feed directing plate side.

Figure 8:
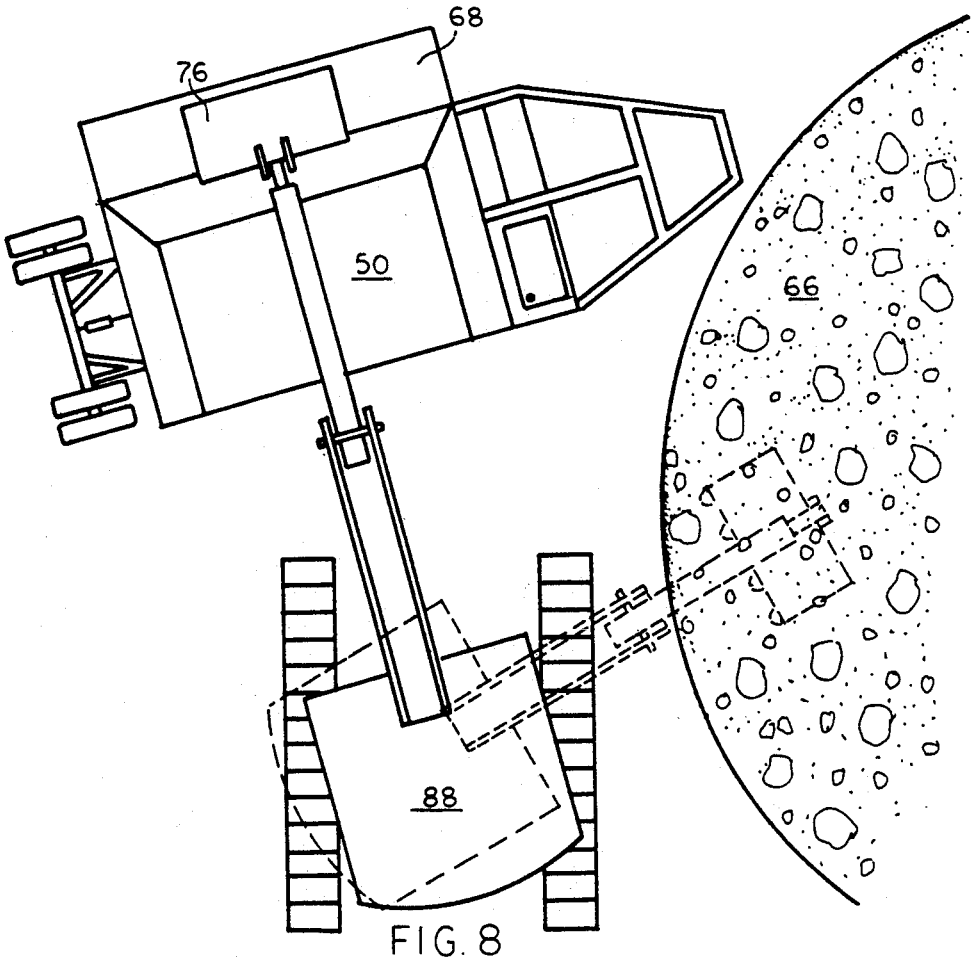
FIG. 8 is a top plan illustrative schematic view of the separating apparatus of the invention with an excavator.

FIG. 8 shows a view of the operation of a separating apparatus 50 of the invention with the feed directing plate extension in a use position (see FIGS. 3 and 4), with a tracked excavator 88 having a bucket 76 with a two boom arm. In operation, the excavator 88 may remain in a fixed position with the longer boom arm pivoting back and forth between the separating apparatus 50 and the feed material stockpile 66. Also, the approach of the excavator bucket 76 to the separating apparatus 50 with the feed directing plate extension is from the opposite side of the separating apparatus 50, with the excavator basket pivoting to discharge the feed material onto the directing plate extension. As indicated in FIG. 8 (see also FIG. 4), with the bucket 76 of the excavator 88 fully extended, the feed material 66 would be discharged past the tall end of the separating apparatus 50 and contaminate the feed material 66 being screened by the apparatus 50, if the feed directing plate extension 68 was not in the use position to receive the feed material 66. Without the presence of the directing plate extension 68, the excavator 88 would have to empty its load of feed material 66 from the bucket 76 further toward the short end of the separating apparatus, which would be on the separating surface 64, thereby decreasing the efficiency of the separating apparatus without the directing plate extension 68 when used with an excavator. The separating apparatus with the movable feed directing plate extension 68 provides flexible operation and permits the use of the apparatus with both a front-end loader and an excavator.

In operation on a site, a means is provided to secure directing plate 68 into the extended support use position by lifting the directing plate up to the angle desired by means of chains attached to the upper portion of the directing plate 68 and lifted by an apparatus designed to lift said chains and directing plate, affixing the support arms 72 to the support brackets 74 and inserting the hitch pins 86 into the support brackets 74 on each side of the frame 52. The directing plate 68 can be removed to the level position by reversing the procedure.

The apparatus of the support bracket 74, support arm 72, and plate 68 may be sold in kit form with the necessary bolts to retrofit existing separating apparatus with the directing plate extension to include, but not be limited to, the SCREEN-ALL®apparatus.

What is claimed is:

1. A separating apparatus for separating a feed material into coarse material and finer material, which apparatus comprises:
   a) a frame having a tall end and a short end formed by sides, with the tall end having a funneling surface, defined by a directing plate extending inwardly and downwardly-angled from the upper edge of the tall end;
   b) a vibratory material separating means sloping downwardly from the bottom end of the funneling surface to near the upper edge of the short end; and
   c) means to vibrate the separating means; the improvement which comprises:
      i) directing plate extension means adapted to receive feed material thereon and to extend upwardly and outwardly from the tall end of the frame to extend the funneling surface of the said directly plate;
      ii) means to connect the directing plate extension means adjacent the said directing plate;
      iii) means to move the connected directing plate extension means between an angular upward extension support and use position to extend the funneling surface of the said directing plate and a retracted, non-support position adjacent the side of the frame at the tall end.

2. The apparatus of claim 1 which includes:
   a) vehicular wheel means movable relative to the frame between an non-operative position and a position to transport the apparatus to an operation site; and
   b) hitch means to permit the apparatus to be towed to an operation site.

3. The apparatus of claim 1 wherein the directing plate extension means extends upwardly and outwardly at about the same angle as the said directing plate.

4. The apparatus of claim 1 wherein the angle of the directing plate and directing plate extension means is about 45 degrees.

5. The apparatus of claim 1 wherein the directing plate extension comprises a flat metal plate having an upper and lower edge and the means to connect comprises a hinge means connected to the lower edge of the directing plate means to permit hinged movement between a use and non-use position.

6. The apparatus of claim 1 wherein the means to move comprises a support bracket means secured to the frame and a support arm means having a one and other end and mounted on the support bracket means with one end of the support arm pivotably connected to the plate directing means, the support arm adapted to move between a non-support, travel position adjacent the frame surface, and a directing plate means support use position extending angularly upright from the support bracket with the other end of the support arm means secured to the support bracket means.

7. The apparatus of claim 1 wherein the directing plate extending means comprises a metal plate having a one lower and other upper end, the means to connect comprises a hinge means secured to the one lower end of the directing plate extension means and adjacent the upper edge of the tall end of the frame, and the means to move comprises a pair of support bracket means spaced apart and secured to the frame and a pair of support arm means mounted each on a support bracket, each support arm pivotably connected at the one end to the upper other end of the plate directing extension means, the support arm adapted to move between a non-support travel position adjacent the frame surface and a support position extending upwardly and angularly outwardly from the frame with the other end of the support arm secured by a removable pin within the support bracket.

8. In combination, an excavator loader and the separating apparatus of claim 1 with the directing plate extension means in a use position.

9. The apparatus of claim 1 wherein the separating means comprises a pair of spaced-apart, angular, vibratory woven screens.

10. The apparatus of claim 1 wherein the separating means comprises a plurality of layers of downwardly extending vibratory spaced-apart rod elements.

11. A method for the separating of coarse material from finer material, which method comprises:

a) providing a portable screening apparatus of claim 1;

b) moving the directing plate extension means of the separating apparatus from a retracted, travel, non-support position to an extended, support, use position; and c) depositing a feed material comprising a mixture of coarse and finer material onto the funneling surface of the plate extension means from a bucket of an excavator payloader for separation of the mixture by the separating surface into a coarse material and a finer material.

12. The method of claim 11 which includes:

a) moving the plate extension means to a retracted, non-support position; and b) moving the separation apparatus to another operation site.

13. The method of claim 12 which includes lifting the directing plate extension means to the same angle as the said directing plate and securing the directing plate extension means in the use position by a hitch pin.

14. The method of claim 11 which includes employing an excavator with a boom arm and a bucket therein to remain in a fixed position and remove feed material from a stockpile and discharge feed material from the bucket of the excavator onto the directing plate extension means in the use position by reaching the boom arm across the separating surface of the apparatus.

* * * * *

UNITED STATES PATENT AND TRADEMARK OFFICE

CERTIFICATE OF CORRECTION

PATENT NO. : 5,244,098

DATED : September 14, 1993

INVENTOR(S) : Robert J. Hadden

It is certified that error appears in the above-identified patent and that said Letters Patent is hereby corrected as shown below:

Claim 1, col. 8, line 45, delete "directly" and insert --directing--.

Claim 5, col. 8, line 68, after "extension" insert --means--.

Claim 6, col. 9., line 9, after "support arm" insert --means--.
line 10, after "support arm" insert --means--.

Claim 7, col. 9, line 17, delete "extending" and insert --extension--.
line 25, after "arm" insert --means--.
line 27, after "support arm" insert --means--.
line 30, after "support arm" insert --means--.
line 31, after "bracket" insert --means--.

Signed and Sealed this

Ninth Day of May, 1995

Bruce Lehman

*Attest:*

BRUCE LEHMAN

*Attesting Officer*

*Commissioner of Patents and Trademarks*